US008655253B2

(12) United States Patent
Kunii et al.

(10) Patent No.: US 8,655,253 B2
(45) Date of Patent: Feb. 18, 2014

(54) GLOSSING DEVICE AND IMAGE FORMING APPARATUS INCORPORATING SAME

(75) Inventors: Hiroyuki Kunii, Kanagawa (JP); Akiyasu Amita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 71 days.

(21) Appl. No.: 13/480,555

(22) Filed: May 25, 2012

(65) Prior Publication Data

US 2012/0328345 A1 Dec. 27, 2012

(30) Foreign Application Priority Data

Jun. 23, 2011 (JP) ..... 2011-139106

(51) Int. Cl.
*G03G 15/20* (2006.01)

(52) U.S. Cl.
USPC ..... 399/341

(58) Field of Classification Search
USPC ..... 399/341, 342, 407
See application file for complete search history.

(56) References Cited

U.S. PATENT DOCUMENTS

| | | | |
|---|---|---|---|
| 6,813,464 | B2 | 11/2004 | Amita et al. |
| 6,957,036 | B2 | 10/2005 | Kikuchi et al. |
| 7,010,257 | B2 | 3/2006 | Someya et al. |
| 7,031,648 | B2 | 4/2006 | Takashi et al. |
| 7,054,570 | B2 | 5/2006 | Kishi et al. |
| 7,116,923 | B2 | 10/2006 | Kishi et al. |
| 7,127,202 | B2 | 10/2006 | Fujita et al. |
| 7,130,555 | B2 | 10/2006 | Kishi et al. |
| 7,139,520 | B2 | 11/2006 | Echigo et al. |
| 7,177,580 | B2 | 2/2007 | Nakafuji et al. |
| 7,209,675 | B2 | 4/2007 | Matsusaka et al. |
| 7,212,758 | B2 | 5/2007 | Kishi et al. |
| 7,212,759 | B2 | 5/2007 | Kishi et al. |
| 7,233,762 | B2 | 6/2007 | Kunii et al. |
| 7,239,821 | B2 | 7/2007 | Matsusaka et al. |
| 7,254,362 | B2 | 8/2007 | Kikuchi et al. |
| 7,269,384 | B2 | 9/2007 | Someya et al. |
| 7,299,003 | B2 | 11/2007 | Kurotaka et al. |
| 7,308,216 | B2 | 12/2007 | Kishi et al. |
| 7,333,743 | B2 | 2/2008 | Kishi et al. |
| 7,333,760 | B2 | 2/2008 | Baba et al. |
| 7,343,113 | B2 | 3/2008 | Matsusaka et al. |

(Continued)

FOREIGN PATENT DOCUMENTS

| | | | |
|---|---|---|---|
| JP | 2004325934 | A | 11/2004 |
| JP | 2005084109 | A | 3/2005 |

(Continued)

*Primary Examiner* — Susan Lee
(74) *Attorney, Agent, or Firm* — Harness, Dickey & Pierce, P.L.C.

(57) ABSTRACT

A glossing device includes a heat roller, a stripper roller, an endless, rotary glossing belt, a first belt cooler, a pressure member, an endless, rotary cooling belt, and a second belt cooler. The heat roller is subjected to heating. The stripper roller is disposed parallel to the heat roller. The glossing belt is looped for rotation around the heat roller and the stripper roller. The first belt cooler is disposed adjacent to the glossing belt to cool the glossing belt. The pressure member is disposed opposite the heat roller. The cooling belt is looped for rotation around the pressure member. The second belt cooler is disposed adjacent to the cooling belt to cool the cooling belt. The heat roller and the pressure member press against each other via the glossing belt and the cooling belt to form a glossing nip therebetween through which the recording medium is conveyed.

20 Claims, 6 Drawing Sheets

(56) References Cited

U.S. PATENT DOCUMENTS

| | | | | |
|---|---|---|---|---|
| 7,356,270 | B2 | 4/2008 | Matsusaka et al. | |
| 7,359,666 | B2 | 4/2008 | Takashi et al. | |
| 7,366,432 | B2 | 4/2008 | Kishi et al. | |
| 7,369,803 | B2 | 5/2008 | Echigo et al. | |
| 7,373,094 | B2 | 5/2008 | Kishi et al. | |
| 7,433,641 | B2 | 10/2008 | Kikuchi et al. | |
| 7,496,309 | B2 | 2/2009 | Matsusaka et al. | |
| 7,515,845 | B2 | 4/2009 | Kishi et al. | |
| 7,526,242 | B2 | 4/2009 | Takagaki et al. | |
| 7,551,869 | B2 | 6/2009 | Kishi et al. | |
| 7,565,087 | B2 | 7/2009 | Matsusaka et al. | |
| 7,570,911 | B2 | 8/2009 | Nakafuji et al. | |
| 7,583,922 | B2 | 9/2009 | Takashi et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,738,827 | B2 | 6/2010 | Someya et al. | |
| 7,783,242 | B2 * | 8/2010 | Chigono et al. | 399/341 |
| 7,885,569 | B2 | 2/2011 | Kishi et al. | |
| 7,912,392 | B2 | 3/2011 | Yoshinaga et al. | |
| 7,925,177 | B2 | 4/2011 | Ishii et al. | |
| 7,957,663 | B2 | 6/2011 | Kishi et al. | |
| 8,073,352 | B2 | 12/2011 | Kunii et al. | |
| 8,081,903 | B2 * | 12/2011 | Hasegawa | 399/341 |
| 8,131,198 | B2 | 3/2012 | Ishii et al. | |
| 2003/0165348 | A1 | 9/2003 | Amita et al. | |
| 2004/0037595 | A1 | 2/2004 | Takashi et al. | |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0025534 | A1 | 2/2005 | Fujita et al. | |
| 2005/0025537 | A1 | 2/2005 | Echigo et al. | |
| 2005/0117943 | A1 | 6/2005 | Nakafuji et al. | |
| 2005/0139584 | A1 | 6/2005 | Kishi et al. | |
| 2005/0152721 | A1 | 7/2005 | Kikuchi et al. | |
| 2005/0158075 | A1 | 7/2005 | Echigo et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2005/0201783 | A1 | 9/2005 | Kurotaka et al. | |
| 2005/0207801 | A1 | 9/2005 | Kunii et al. | |
| 2005/0286920 | A1 | 12/2005 | Baba et al. | |
| 2006/0008302 | A1 | 1/2006 | Someya et al. | |
| 2006/0013624 | A1 | 1/2006 | Kurotaka et al. | |
| 2006/0019082 | A1 | 1/2006 | Kikuchi et al. | |
| 2006/0029411 | A1 | 2/2006 | Ishii et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0088349 | A1 | 4/2006 | Someya et al. | |
| 2006/0120776 | A1 | 6/2006 | Takashi et al. | |
| 2006/0127118 | A1 | 6/2006 | Kishi et al. | |
| 2006/0140689 | A1 | 6/2006 | Echigo et al. | |
| 2006/0182460 | A1 | 8/2006 | Kishi et al. | |
| 2007/0014600 | A1 | 1/2007 | Ishii et al. | |
| 2007/0031159 | A1 | 2/2007 | Kishi et al. | |
| 2007/0065188 | A1 | 3/2007 | Takagaki et al. | |
| 2007/0104520 | A1 | 5/2007 | Nakafuji et al. | |
| 2007/0212090 | A1 | 9/2007 | Matsusaka et al. | |
| 2008/0145088 | A1 | 6/2008 | Matsusaka et al. | |
| 2008/0219716 | A1 | 9/2008 | Takashi et al. | |
| 2008/0253789 | A1 | 10/2008 | Yoshinaga et al. | |
| 2009/0123172 | A1 | 5/2009 | Kishi et al. | |
| 2009/0169232 | A1 | 7/2009 | Kunii et al. | |
| 2009/0317113 | A1 | 12/2009 | Kishi et al. | |
| 2010/0232818 | A1 | 9/2010 | Kunii | |
| 2011/0064494 | A1 | 3/2011 | Amita et al. | |
| 2011/0085815 | A1 | 4/2011 | Kishi et al. | |
| 2011/0176822 | A1 | 7/2011 | Ishii et al. | |
| 2011/0188911 | A1 | 8/2011 | Kunii et al. | |
| 2012/0008153 | A1 | 1/2012 | Kunii et al. | |
| 2012/0201579 | A1 | 8/2012 | Kunii et al. | |
| 2012/0224898 | A1 | 9/2012 | Amita et al. | |
| 2012/0328243 | A1 * | 12/2012 | Fang et al. | |
| 2012/0328344 | A1 * | 12/2012 | Kunii et al. | 399/341 |
| 2013/0202337 | A1 * | 8/2013 | Shirai et al. | 399/341 |

FOREIGN PATENT DOCUMENTS

| | | | |
|---|---|---|---|
| JP | 2006258953 | A | 9/2006 |
| JP | 2008170771 | A | 7/2008 |
| JP | 2008268374 | A | 11/2008 |
| JP | 2010152399 | A | 7/2010 |

* cited by examiner

GLOSSING DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-139106, filed on Jun. 23, 2011, the entire disclosure of which is hereby incorporated by reference herein.

BACKGROUND OF THE INVENTION

1. Technical Field

The present invention relates to a glossing device and an image forming apparatus incorporating the same, and more particularly, to a glossing device that processes a toner image with heat and pressure on a recording medium, and an electrophotographic image forming apparatus, such as a photocopier, facsimile machine, printer, plotter, or multifunctional machine incorporating several of these features, which incorporates such a glossing capability.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

FIG. 1 is an end-on, axial view of an example of a fixing device 300 used in electrophotographic image formation.

As shown in FIG. 1, the fixing device 300 includes a dual-roller assembly formed of a pair of opposed rotary members disposed parallel to each other, one being a fuser roller 301 internally heated with a heat source 302 and rotatably driven with a rotary motor, and the other being a pressure roller 302 elastically biased against the fuser roller 301 to form a fixing nip N therebetween.

During operation, the heat source 302 imparts heat from inside the fuser roller 301 to maintain the outer surface of the roller 301 at an operational temperature greater than a softening temperature of toner in use. Then, as the fuser roller 301 rotates in a given rotational direction (clockwise in the drawing) to in turn cause the pressure roller 302 in an opposite rotational direction (counterclockwise in the drawing), a recording sheet S enters the fixing nip N with its printed surface (i.e., the side on which a toner image T is deposited) facing the fuser roller 301, which melts and fuses toner with heat from the fuser roller 301 and pressure between the opposed rollers 301 and 303. After passage through the fixing nip N, the recording sheet S cools to cause the molten toner thereon to cool and solidify, resulting in the toner image T fixed in place on the recording sheet S.

One important factor that determines performance of fixing process is its capability to impart high, uniform gloss to the resulting print, which is particularly required by modern image forming apparatuses which accommodate a wide range of printing applications with different levels of image quality, using various types of recording media. In particular, printing of photographs and computer-generated images, which typically contain a wide, complete range of visible colors, necessitates a higher level of image quality and uniformity of image gloss than is required for conventional monochrome image formation.

Various techniques have been proposed to meet a growing demand for printers with high-gloss, high-quality imaging performance. Some such techniques employ a special, transparent toner, called "clear toner", for creating a transparent glossy effect on those areas of a recording medium where no color toner is deposited; others address duplex printing with a uniform, glossy finish on both sides of a recording medium. Among these, several techniques are directed to development of a more sophisticated fixing process.

Structurally, a fixing device with a glossing capability may be constructed of an endless rotary belt on which a recording medium is conveyed while subjected to heat and pressure. The endless belt is looped for rotation around multiple parallel rollers, including a heated roller and a separator roller, with a pressure roller disposed opposite the heated roller via the belt to form a fixing nip therebetween. During operation, a recording medium is conveyed through the fixing nip to process a toner image under heat and pressure. After passage through the fixing nip, the recording medium closely contacts the belt as the belt moves from the heated roller toward the separator roller, and separates from the belt as the belt passes around the separator roller.

For example, a fixing system has been proposed which includes a primary fixing unit and a secondary fixing unit disposed downstream from the primary fixing unit. The secondary fixing unit includes a pair of opposed belt assemblies, each of which consists of an endless rotary belt entrained around a heat roller and a stripper roller. The two heat rollers and the two stripper rollers press against their respective counterparts on the opposite side of the glossing device to define an elongated area of contact or nip extending from between the heat rollers to between the stripper rollers, along which a recording medium is conveyed between the rotating belts.

In this fixing system, after initially passing through the primary fixing unit to fix a toner image in place with heat and pressure, a recording medium is conveyed to the secondary fixing unit. Upon entry into the secondary fixing unit, the recording medium is heated between the heat rollers to remelt the once-fixed toner image thereon, and then is gradually cooled as it passes toward the stripper rollers along the length of the elongated nip, causing the toner image to conform to the smooth surface of the endless belt. As the recording medium exits the elongated nip, the toner image solidifies and thus exhibits increased gloss and smooth appearance.

Also, another belt-based fixing system has been proposed which includes a thermal pre-fixing unit and a gloss adjustment unit. The pre-fixing unit consists of a pair of opposed heated rollers pressing against each other to form a pre-fixing nip therebetween. The gloss adjustment unit consists of a smooth, endless rotary belt entrained around a pair of motor-driven and idler rollers, with a pressure roller opposite the motor-driven roller to form a main, fixing nip therebetween.

In this fixing system, a recording medium is initially passed through the pre-fixing unit, which renders an unfixed powder toner image into a semi-fluid, soft pliable state. After pre-fixing, the recording medium is conveyed to the gloss adjustment unit with the toner image pressed against the endless belt, which imparts gloss to the toner image as the molten toner gradually cools and solidifies while conforming to the smooth surface of the belt. The gloss adjustment unit adjusts glossiness of the toner image by adjusting a distance or duration during which the toner image travels on the belt downstream from the fixing nip.

To date, belt-based glossing devices are designed with a belt cooler for cooling an endless rotary belt during conveyance of a recording medium downstream from a fixing nip, so as to provide uniform cooling and proper separation of the recording medium from the belt after fixing and glossing a toner image thereon.

For example, the aforementioned fixing system with the gloss adjustment capability is equipped with a cooling device, such as a heat-dissipating fin or an electrical fan, disposed inside the loop of the endless belt. This cooling device serves to cool the belt opposite where the belt faces the recording medium conveyed downstream from the fixing nip, which in turn cools the recording medium as well as a toner image printed thereon.

Although generally successful for their intended purposes, conventional techniques for cooling an endless rotary belt in a glossing device have several drawbacks.

One drawback is that the belt cooler often fails to accommodate different thermal properties of the endless belt which depend on specific material and application of the glossing process.

For example, a relatively high heat capacity of the belt material reduces thermal efficiency of the belt cooler, which can lead to variations in glossing performance where the belt accumulates substantial amounts of heat during sequential processing of a large number of recording media, which causes the resulting prints to exhibit varying levels of image gloss over time. On the other hand, a relatively low heat capacity of the belt material makes it difficult to sufficiently cool the toner image, particularly where the recording medium in use is a thick substrate of paper that exhibits a greater heat capacity than that of the endless belt. Increasing the length of belt to remedy the problem does not always work, since it would cause a concomitant increase in overall size of the equipment which is not desirable for application to today's compact printers.

Another drawback arises where the glossing device is applied to an image forming apparatus that incorporates a duplex printing capability to allow image formation on a pair of opposed, first and second surfaces of a recording medium. During duplex printing where the glossing device processes a duplex-printed recording medium that has a first toner image already fixed and glossed on its first surface, and a second toner image fixed and yet to be glossed on its second surface, applying heat and pressure to the recording medium for glossing the second toner image can affect the gloss and quality of the first toner image, as the first toner image remains substantially hot and thus is readily deformed under pressure as the recording medium passes through the glossing nip.

SUMMARY OF THE INVENTION

Exemplary aspects of the present invention are put forward in view of the above-described circumstances, and provide a novel glossing device for processing a toner image formed on a recording medium.

In one exemplary embodiment, the glossing device includes a heat roller, a stripper roller, an endless, rotary glossing belt, a first belt cooler, a pressure member, an endless, rotary cooling belt, and a second belt cooler. The heat roller is subjected to heating. The stripper roller is disposed parallel to the heat roller. The glossing belt is looped for rotation around the heat roller and the stripper roller. The first belt cooler is disposed adjacent to the glossing belt to cool the glossing belt. The pressure member is disposed opposite the heat roller. The cooling belt is looped for rotation around the pressure member. The second belt cooler is disposed adjacent to the cooling belt to cool the cooling belt. The heat roller and the pressure member press against each other via the glossing belt and the cooling belt to form a glossing nip therebetween through which the recording medium is conveyed with a first surface thereof facing the cooling belt and a second surface opposite the first surface thereof facing the glossing belt. The glossing belt and the cooling belt move apart from each other downstream from the glossing nip, so that the recording medium after passage through the glossing nip remains in contact with the glossing belt and separates from the cooling belt as the glossing belt moves from the heat roller toward the stripper roller.

Other exemplary aspects of the present invention are put forward in view of the above-described circumstances, and provide an image forming apparatus incorporating the glossing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
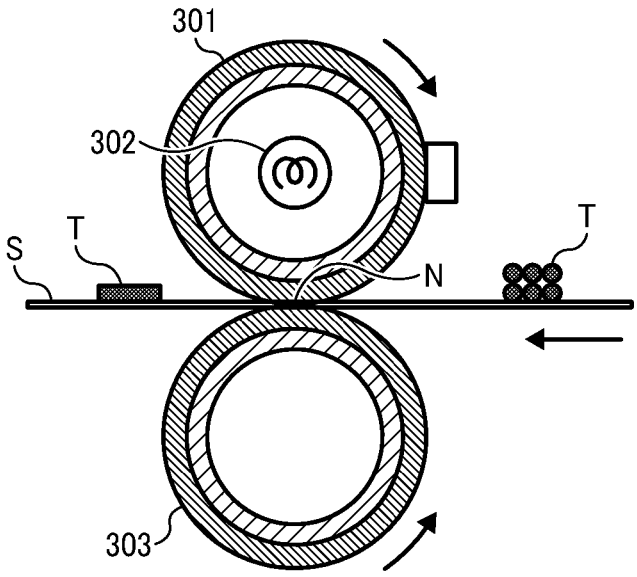
FIG. 1 BACKGROUND ART
FIG. 1 is an end-on, axial view of an example of a fixing device used in electrophotographic image formation.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
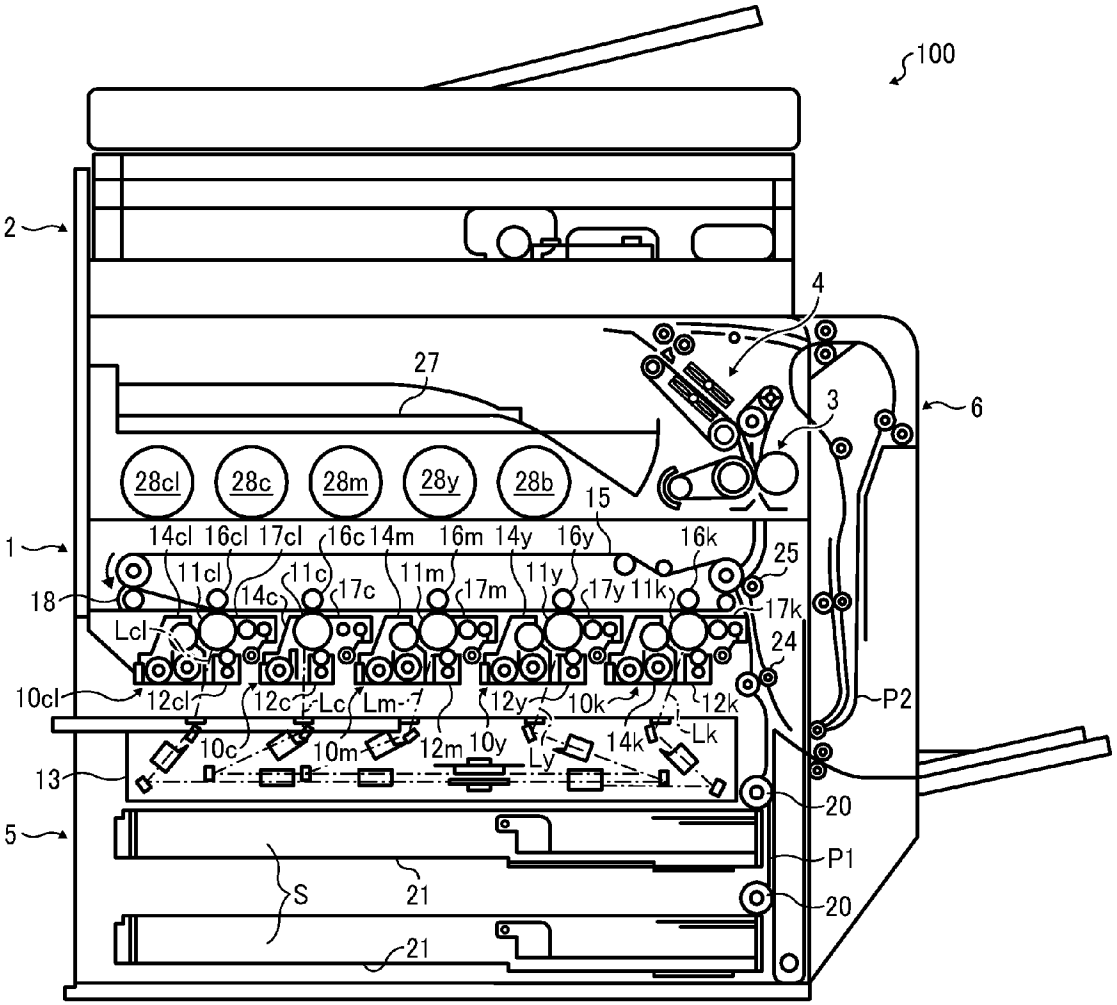
FIG. 2 schematically illustrates an image forming apparatus according to one or more embodiments of this patent specification.

FIG. 2 schematically illustrates an image forming apparatus 100 according to one or more embodiments of this patent specification.

As shown in FIG. 2, the image forming apparatus 100 in the present embodiment includes a printing unit 1 located at a central part of the apparatus body for printing a toner image on a recording medium such as a sheet S of paper, above which may be deployed an image scanning unit 2 for capturing image information from a user-supplied original document.

In the image forming apparatus 100, the printing unit 1 comprises a tandem color printer including five imaging stations 10*cl*, 10*c*, 10*m*, 10*y*, 10*k* arranged in series generally horizontally below an intermediate transfer belt 15 and above an exposure unit 13, which together form an electrophotographic mechanism to form an image with toner particles on a recording sheet S.

The imaging stations (indicated collectively by the reference numeral 10) are of a substantially identical configuration, each having a drum-shaped photoconductor 11 surrounded by a charging device 12 for charging the photoconductor surface to generate a latent image, a development device 14 for developing the latent image into a visible form using toner, and a cleaning device 17 for cleaning the photoconductive surface of residual toner, which work in cooperation to form a toner image of a particular color, as designated by the suffixes "c" for cyan, "m" for magenta, "y" for yellow, "k" for black, and "cl" for a clear or transparent color. The imaging stations 10*cl*, 10*c*, 10*m*, 10*y*, 10*k* are supplied with toner from toner bottles 28*cl*, 28*c*, 28*m*, 28*y*, and 28*k*, respectively, each of which is connected with the development device 14 through a suitable piping or conduit for transporting toner.

The intermediate transfer belt 15 is entrained around multiple belt support rollers and primary transfer rollers 16*cl*, 16*c*, 16*m*, 16*y*, and 16*k* for rotation counterclockwise in the drawing, passing through five primary transfer nips defined between the primary transfer rollers 16 and the corresponding photoconductive drums 11, and then through a secondary transfer nip defined between a belt support roller and a secondary transfer roller 25, followed by meeting a belt cleaner 18 downstream from the secondary transfer nip.

Located adjacent to the intermediate transfer belt 15 is a fixing system including a fixing device 3 for fixing a toner image in place on a recording sheet S, and a glossing device 4 for imparting gloss to the toner image after fixing. Each of the fixing and glossing devices 3 and 4 includes a pair of opposed rotary members, at least one of which is heated, and at least one of which is pressed against the other one, to form a heated area of contact called a nip, through which the recording sheet S is conveyed for processing the toner image with heat and pressure. Specific configurations of the fixing system will be described later in more detail with reference to FIG. 3 and subsequent drawings.

Extending from below the exposure unit 13 upward to the fixing system is a media conveyance mechanism 5, including one or more input sheet trays 21 each accommodating a stack of recording sheets S for feeding with a feed roller 20, as well as various conveyor and guide members, such as a pair of registration rollers 24, together defining a sheet conveyance path P1 along which a recording sheet S advances upward from the input tray 21 to pass through the secondary transfer nip and then through the fixing system to finally reach an in-body output sheet tray 27.

The image forming apparatus 100 also includes a duplex unit 6 located on one side of the apparatus body for inverting a recording sheet S during duplex printing. The duplex unit 6 includes multiple guide and conveyance members together defining a sheet inverting path P2 along which a recording sheet S is inverted while conveyed downward from the fixing system to reenter the sheet conveyance path P1.

During operation, the printing unit 1 activates the imaging stations 10 to form a toner image on an outer surface of the intermediate transfer belt 15 according to image data supplied from a data source, such as from the image scanning unit 2 in case of photocopying, from a host computer in case of printing, or from a remote location via a phone line in case of facsimile.

Specifically, upon activation, each imaging station 10 rotates the photoconductor drum 11 counterclockwise in the drawing to forward its outer, photoconductive surface to a series of electrophotographic processes, including charging, exposure, development, transfer, and cleaning, in one rotation of the photoconductor drum 11.

First, the photoconductive surface is uniformly charged to a particular polarity by the charging device 12 and subsequently exposed to a modulated laser beam L emitted from the exposure unit 13 to which electronic signals are supplied from a data source. The laser exposure selectively dissipates the charge on the photoconductive surface to form an electrostatic latent image thereon according to image data representing a particular primary color. Then, the latent image enters the development device 14 which renders the incoming image visible using toner. The toner image thus obtained is forwarded to the primary transfer nip between the intermediate transfer belt 15 and the primary transfer roller 16.

At the primary transfer nip, the primary transfer roller 16 is supplied with a bias voltage of a polarity opposite that of the toner on the photoconductor drum 11. This electrostatically transfers the toner image from the photoconductive surface to an outer surface of the belt 15, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 15.

After primary transfer, the photoconductor 11 enters the cleaning device 17 to remove residual toner from the photoconductive surface for preparation for a subsequent imaging cycle. At the same time, the intermediate transfer belt 15 forwards the multicolor image to the secondary transfer nip between the belt support roller and the secondary transfer roller 25.

Meanwhile, in the media conveyance unit 5, the conveyor rollers introduce a recording sheet S from the input sheet tray 21 toward the pair of registration rollers 24 being rotated. Upon receiving the fed sheet S, the registration rollers 24 stop rotation to hold the incoming sheet S therebetween, and then advance it in sync with the movement of the intermediate transfer belt 15 to the secondary transfer nip. At the secondary transfer nip, the multicolor image is transferred from the belt 15 to the recording sheet S.

After secondary transfer, the intermediate transfer belt 15 advances to the belt cleaner 18, which removes residual toner from the belt surface to prepare it for a subsequent imaging cycle. At the same time, the recording sheet S bearing the powder toner image thereon is introduced into the fixing unit, at which the fixing device 3 fixes the multicolor image in place on the recording sheet S with heat and pressure, followed by the glossing device 4 processing the fixed toner image with heat and pressure to impart gloss to the resulting print.

Where duplex printing is intended, the recording sheet S after passage through the fixing and glossing devices 3 and 4 enters the duplex unit 6. During conveyance through the sheet conveyance path P2, the incoming sheet S is turned upside down for subsequent reentry into the sheet conveyance path P1 where a second toner image is printed and fixed onto another, opposite side of the recording sheet S.

After simplex or duplex printing is completed, the recording sheet S is ejected to the output tray 27 for stacking inside the apparatus body, which completes one operational cycle of the image forming apparatus 100.

Although the embodiment above is directed to an operation in which printing is performed using all the five imaging stations 10 to form a full-color image with a glossy, textured surface, the image forming apparatus 100 may selectively operate in multiple modes of operation, such as a monochrome mode and a multi- or full-color mode, with a specific combination of imaging stations 10*cl*, 10*c*, 10*m*, 10*y*, 10*k* activated to create an image in a particular color or tone as desired.

Also, the image forming apparatus 100 may selectively operate in a glossing mode in which a toner image is finished with an enhanced gloss, or in a normal fixing mode in which a toner image is processed without gloss finishing, as specified by a user, or depending on the type of recording medium S used in a given print job. In such cases, the glossing device 4 is configured to change relative positions of the rotary members forming a nip therebetween, which is selectively established during operation in the normal fixing mode and de-established during operation in the glossing mode.

Figure 3:
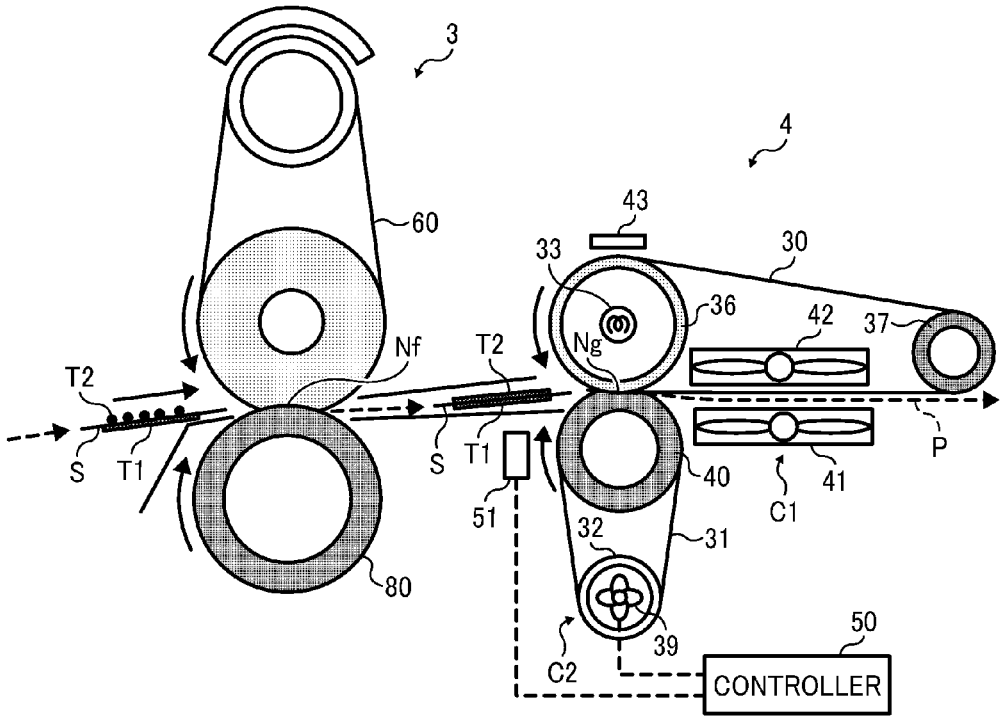
FIG. 3 is an end-on, axial view of a fixing system including a glossing device according to one or more embodiments of this patent specification.

FIG. 3 is an end-on, axial view of the fixing system according to one or more embodiments of this patent specification.

As shown in FIG. 3, the fixing system includes a fixing device 3 to fix a toner image T in place on a recording sheet S conveyed along a sheet conveyance path P, and a glossing device 4 disposed downstream from the fixing device 3 along a sheet conveyance path P to process the toner image T with heat and pressure, so as to impart gloss to the resulting print on the recording sheet S.

The fixing device 3 includes a pair of rotary fixing members 60 and 80, at least one of which is heated, and at least one of which is pressed against the other one to form a fixing nip Nf therebetween. In the present embodiment, for example, the fixing device 3 includes a heated, endless fuser belt 60 paired with a pressure roller 80 pressed against the fuser belt 60. Any suitable type of heating mechanism may be employed to heat the fuser belt 60, such as, for example, a radiant, halogen lamp or an electromagnetic induction heater, depending on specific configurations of the fixing process.

The glossing device 4 includes a heat roller 36 subjected to heating; a stripper roller 37 disposed parallel to the heat roller 36; an endless, rotary glossing belt 30 looped for rotation around the heat roller 36 and the stripper roller 37; a first belt cooler C1 disposed adjacent to the glossing belt 30 to cool the glossing belt 30; a pressure member 40 disposed opposite the heat roller 36; an endless, rotary cooling belt 31 looped for rotation around the pressure member 40; and a second belt cooler C2 disposed adjacent to the cooling belt 31 to cool the cooling belt 31. The heat roller 36 and the pressure roller 40 press against each other via the glossing belt 30 and the cooling belt 31 to form a glossing nip Ng therebetween through which the recording sheet S is conveyed as the opposed rollers 36 and 40 rotate together.

The glossing device 4 also includes a heater 33 disposed in the heat roller 36 to heat the glossing belt 30, and a non-contact temperature sensor or thermometer 43 disposed adjacent to the heat roller 36 outside the loop of the glossing belt 30 and on the side of the heat roller 36 away from the pressure roller 40 to measure temperature at an outer surface of the glossing belt 30. A controller, such as a central processing unit (CPU) with associated memory devices, may be provided to optimize operation of the heater 33 according to readings of the thermometer 43 to maintain the belt temperature at a desired operational temperature.

Specifically, in the present embodiment, the heat roller 36 comprises a cylindrical body of thermally conductive material, such as aluminum, stainless steel, iron, or the like, approximately 30 mm to approximately 90 mm in diameter. An optional, coating layer of elastic material, such as silicone rubber or the like, approximately 0.5 mm to approximately 5 mm thick, may be provided on an outer surface of the heat roller 36 to create an increased area of contact between the opposed rollers 36 and 40 at the glossing nip Ng.

The stripper roller 37 comprises a cylindrical body of suitable material, such as iron, aluminum, stainless steel, or the like, approximately 10 mm to approximately 30 mm in diameter.

The glossing belt 30 comprises a looped, endless flexible belt of heat-resistant resin or metal, such as polyimide, nickel, stainless steel, or the like, approximately 10 μm to approximately 200 μm in thickness, and approximately 80 mm to approximately 300 mm in diameter in its generally cylindrical configuration. An optional, coating layer of elastic material, such as silicone rubber or the like, approximately 5 μm to approximately 50 μm thick may be provided on the outer surface of the glossing belt 30 for allowing close, uniform contact with the printed surface of the recording sheet S conveyed on the glossing belt 30. Also, the outermost surface of the glossing belt 30 may be provided with a coating of release agent, such as silicone or fluorine resin, for providing ready separation of the recording sheet S from the glossing belt 30.

The heater 33 comprises any suitable heat source that generates an amount of heat sufficient to re-melt and re-fuse toner accommodated in the fixing system. In the present embodiment, for example, the heater 33 is a halogen heater disposed inside the heat roller 36 to radiate heat to an inner surface of the heat roller 36, from which heat is imparted to the glossing belt 30 entrained around the heated roller 36. Operation of the heater 33 is computer-controlled according to readings of the thermometer 43 so as to maintain the belt surface at a desired operational temperature.

The first belt cooler C1 comprises one or more cooling elements disposed adjacent to the glossing belt 30, such as, for example, a pair of cooling fans 41 and 42 disposed outside and inside, respectively, of the loop of the glossing belt 30. The configuration of the cooling elements is not limited to the cooling fans, but includes any suitable cooling device, such as a heat sink, a heat pipe, a Peltier or thermoelectric cooler, and the like.

The pressure roller 40 comprises a cylindrical body approximately 30 mm to approximately 90 mm in diameter, consisting of a cylindrical core of suitable material, such as iron, aluminum, stainless steel, or the like, covered with an outer layer of elastic material, such as fluorine rubber, silicone rubber, or the like, approximately 1 mm to approximately 50 mm thick, deposited on the cylindrical core.

The pressure roller 40 is equipped with a suitable biasing mechanism formed, for example, of a rotary actuator connected to the roller rotational axis through a cam, which allows the pressure roller 40 to move relative to the glossing belt 30 and the heat roller 36, so as to adjust width and strength of the glossing nip Ng determined by relative positions of the rotational axes of the opposed rollers 36 and 40.

The pressure roller 40 also has a suitable rotary driver motor connected to the roller rotational axis, which rotationally drives the roller 40 to in turn rotate the cooling belt 31 and any rotary element in contact therewith, causing the glossing belt 30 to rotate together with the heat roller 36 and the stripper roller 37.

The cooling belt 31 comprises a looped, endless flexible belt formed of a substrate of heat-resistant resin or metal, such as polyimide, nickel, stainless steel, or the like, approximately 30 μm to approximately 100 μm thick, and an outer layer of release agent, such as fluorine compound, approximately 5 μm to approximately 50 μm thick on the substrate. An optional, intermediate layer of elastic material, such as silicone rubber may be provided between the substrate and the release layer.

The second belt cooler C2 comprises one or more cooling elements disposed adjacent to the cooling belt 31, such as a cooling fan, a heat sink, a heat pipe, a Peltier or thermoelectric cooler, and the like. The second belt cooler C2 is disposed inside the loop of the cooling belt 31 to internally cool the cooling belt 31 together with the pressure roller 40 accommodated therein. Alternatively, instead, the second belt cooler C2 may be disposed outside the loop of the cooling belt 31 to externally cool the cooling belt 31. Specific configurations of the second belt cooler C2 and its associated structure will be described later in more detail.

During operation, after image formation through a series of electrophotographic processes as described above with reference to FIG. 2, a recording sheet S bearing an unfixed toner image T thereon enters the fixing device 3.

In the fixing device 3, the incoming sheet S passes through the fixing nip Nf, which melts and fuses toner with heat from the fuser belt 60 and pressure from the pressure roller 80, resulting in the toner image T fixed in place on the recording sheet S. After fixing, the recording sheet S enters the glossing device 4.

In the glossing device 4, the incoming sheet S initially passes through the glossing nip Ng along the opposed rotating belts 30 and 31, which re-melts the once-fixed toner image T with heat from the heat roller 36 and pressure between the opposed rollers 36 and 40. The recording sheet S after passing through the glossing nip Ng is conveyed with its printed surface contacting the surface of the glossing belt 30, as the belt 30 moves from the heat roller 36 toward the stripper roller 37.

Traveling on the glossing belt 30 from the heat roller 36 toward the stripper roller 37, the recording sheet S is subjected to rapid cooling from both sides of the looped belt, as the cooling fan 41 directs an air flow to the outer, front side of the belt 30 and the cooling fan 42 directs an air flow to the inner, back side of the belt 30. As the recording sheet S cools, the re-molten toner T solidifies by being cooled below its glass transition temperature to assume a smooth, uniform surface in conformity with the smooth outer surface of the glossing belt 30, resulting in a smooth, glossy effect created on the printed surface of the recording sheet S.

Thereafter, the recording sheet S conveyed on the rotating belt 30 meets the stripper roller 37, at which the curvature of the stripper roller 37 causes the sheet S to separate from the belt surface and finally exit the glossing device 4.

As mentioned earlier, the glossing device 4 is installable in the image forming apparatus 100 which incorporates a duplex printing capability to allow image formation on a pair of opposed, first and second surfaces of a recording sheet S, wherein the imaging unit initially forms a first toner image T1 on the first surface, and a second toner image T2 on the second surface subsequent to processing of the first toner image T1 through the glossing device 4. In such cases, the recording sheet S is conveyed through the glossing nip Ng with the first surface facing the glossing belt 30 and the second surface facing the cooling belt 31 during processing of the first toner image T1, and with the second surface facing the glossing belt 30 and the first surface facing the cooling belt 31 during processing of the second toner image T2.

With continued reference to FIG. 3, the glossing device 4 is shown with the glossing belt 30 and the cooling belt 31 moving apart from each other downstream from the glossing nip Ng, so that the recording sheet S after passage through the glossing nip Ng remains in contact with the glossing belt 30 and separates from the cooling belt 31 as the glossing belt 30 moves from the heat roller 36 toward the stripper roller 37, and subsequently separates from the glossing belt 30 as the glossing belt 30 passes around the stripper roller 7.

Specifically, in the present embodiment, the cooling roller 32 is positioned away from a tangent plane between the two rollers 36 and 37 around which the glossing belt 30 is entrained, so as to retain the cooling belt 31 away from contact with the glossing belt 30 except at the glossing nip Ng.

In such a configuration, a recording sheet S upon entering the glossing device 4 is sandwiched between the glossing belt 30 and the cooling belt 31 which contact each other solely at the glossing nip Ng defined between the opposed rollers 36 and 40. During passage through the glossing nip Ng, the recording medium S adheres to the glossing belt 30 as the toner image becomes adhesive due to heat from the heat roller 36, which enables the outgoing sheet S to follow the sheet conveyance path P along the glossing belt 30 and apart from the cooling belt 31 to properly exit the glossing device 4.

Figure 4:
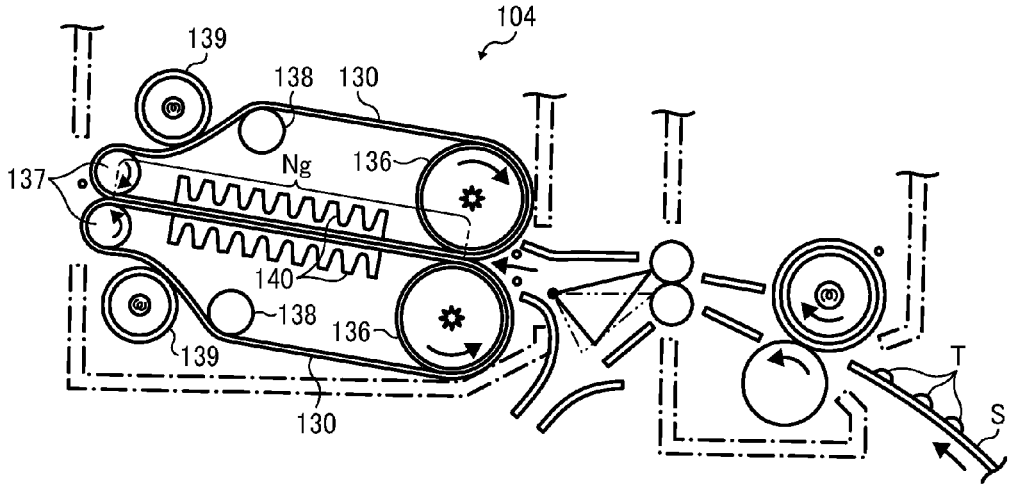
FIG. 4 is an end-on, axial view of a belt-based glossing device that employs a pair of opposed belt assemblies.

For comparison purposes, and for allowing a better understanding of this special configuration of the glossing device 4 according to this patent specification, consider a belt-based glossing device 104 that employs a pair of opposed belt assemblies, with reference to FIG. 4.

As shown in FIG. 4, the glossing device 104 includes a pair of opposed belt assemblies, each of which consists of an endless rotary belt 130 looped for rotation around a heat roller 136 and a stripper roller 137, as well as one or more belt support rollers 138 and 139 disposed inside or outside the loop of the belt 130. The two heat rollers 136 and the two stripper rollers 137 press against their respective counterparts on the opposite side of the glossing device to define an elongated area of contact or nip Ng extending from between the heat rollers 136 to between the stripper rollers 137, along which a recording sheet S is conveyed between the rotating belts 130. A pair of cooling fins 140 is provided along the elongated glossing nip Ng, one inside the loop of each endless rotary belt 130.

One problem associated with such a glossing device 104 is the difficulty in driving the opposed rotary belts 130 in sync with each other. Unsynchronized movement of the belt assemblies would lead to image defects, such as smearing or shifting, of the resulting print where the recording sheet S is conveyed at non-uniform circumferential speeds of the opposed belts 130.

Another problem is that sandwiching a recording sheet S along the elongated nip Ng between the opposed rotary belts 130 translates into an absence of vent through which water vapor or other gases can escape from the recording sheet S after being heated and pressed between the opposed heat rollers 136. Failure to properly dissipate water content from the recording sheet S after thermal processing would eventually cause blistering or other image defects of the resulting print.

The glossing device 4 according this patent specification is exempted from these and other problems of the belt-based glossing device, owing to the special configuration of the glossing belt 30 and the cooling belt 31 moving apart from each other downstream from the glossing nip Ng, which effectively prevents image defects resulting from a difference in circumferential speed between the opposed rotating belts, while allowing for proper dissipation of water content from the recording medium after passage through the glossing nip.

Further, as mentioned earlier, the glossing device 4 according to this patent specification is equipped with the dedicated, second belt cooler C2 for cooling the cooling belt 31. In the present embodiment, the second belt cooler C2 includes a hollow, thermally conductive cooling roller 32 around which the cooling belt 31 is entrained to dissipate heat from the cooling belt 31 to the cooling roller 32. The cooling roller 32 may be a cylindrical body of thermally conductive material, such as aluminum, stainless steel, iron, or the like, approximately 30 mm to approximately 60 mm in diameter.

The second belt cooler C2 also includes a pair of cooling fans 39, one on each of two opposed, axial ends of the cooling roller 32, of which only one is visible in FIG. 3. Both cooling fans 39 serve to blow air in one axial direction of the cooling roller 39 to together generate an air flow from one end to the other of the cooling roller 39, which promotes dissipation of heat through the cooling roller 32 to effectively cool the cooling belt 31 as well as the pressure roller 40.

Additionally, the second belt cooler C2 may have a pair of air ducts, one coupled to each cooling fan 39, both air ducts leading to the exterior of an enclosure in which the glossing device 4 is installed to ventilate the cooling roller 32. Provision of such air ducts, in combination with the cooling fans 39, allows for increased efficiency in cooling the thermally conductive roller 32.

In such a configuration, the second belt cooler C2, which transfers waste heat from the belt 31 with the cooling elements 39 accommodated in the cooling roller 32, can cool the cooling belt 31 without intervention of the pressure roller 40 between the belt 31 and the cooling element. Compared to a configuration in which cooling elements are accommodated in a pressure member formed of an elastic material, such as fluorine rubber or silicone rubber, that exhibits a high heat capacity, deploying the cooling elements 39 in the thermally conductive, hollow cooling roller 39 provides rapid dissipation of heat from the cooling belt 31, and thus allows for efficient cooling of the cooling belt 31

Providing the cooling belt 31 with the second belt cooler C2 allows for excellent imaging performance of the glossing device 4, particularly during duplex printing where the glossing device 4 processes a recording sheet S that has a first toner image already fixed and glossed on its first surface, and a second toner image fixed and yet to be glossed on its second surface.

Specifically, during duplex printing, a recording sheet S having a first toner image T1 already fixed and glossed on its first surface again undergoes a series of electrophotographic imaging processes to form a second toner image T2 on its another, second surface opposite the first surface. Upon entering the fixing system along the sheet conveyance path P, the incoming sheet S first passes through the fixing device 3 for fixing the powder toner image T2, and then proceeds to the glossing device 4 for imparting gloss to the fixed toner image T2.

Note that the duplex-printed sheet S, having the first toner image T1 already fixed and glossed on its first surface, and the second toner image T2 fixed and yet to be glossed on its second surface, passes through the glossing nip Ng with the first surface facing the cooling belt 31 and the second surface facing the glossing belt 30. Since the second belt cooler C2 effectively removes heat from the cooling belt 31, the first surface of the recording sheet S remains substantially unheated as it contacts the cooling belt 31 through the glossing nip Ng. Consequently, during glossing of the second toner image T2, the first toner image T1 retains its solid, fixed configuration on the first surface of the recording sheet S even in the presence of heat and pressure causing the second toner image T2 to re-melt on the second surface of the same recording sheet S.

Thus, the glossing device 4 can process a duplex-printed recording medium S with high-gloss, defectless images on both sides of the resulting print, wherein provision of the cooling belt 31 with the second belt cooler C2 prevents undesired re-melting of the first toner image T1 during processing of the second toner image T2, which would otherwise lead to concomitant loss of gloss and unstable quality of the first printed surface of the resulting print.

With still continued reference to FIG. 3, the glossing device 4 is shown further including a thermometer 51 disposed adjacent to the cooling belt 31 to detect an operational temperature of the cooling belt 31, and a controller 50, such as a central processing unit (CPU) with associated memory devices, operatively connected with the second belt cooler C2 and the thermometer 51 to control operation of the second belt cooler C2 for adjusting the operational temperature of the cooling belt 31 according to readings of the thermometer 51.

The operational temperature of the cooling belt 31 may be adjusted to an optimum value depending on specific application of the glossing device 4. For example, during processing of a recording sheet S that has a first toner image T1 already fixed and glossed on its first surface, and a second toner image T2 fixed and yet to be glossed on its second surface, the operational temperature of the cooling belt 31 is adjusted not to exceed an upper limit of approximately 80° C., so as to keep the first toner image T1 in a solid, fixed state where the first surface of the recording sheet S contacts the cooling belt 31.

Figure 5:
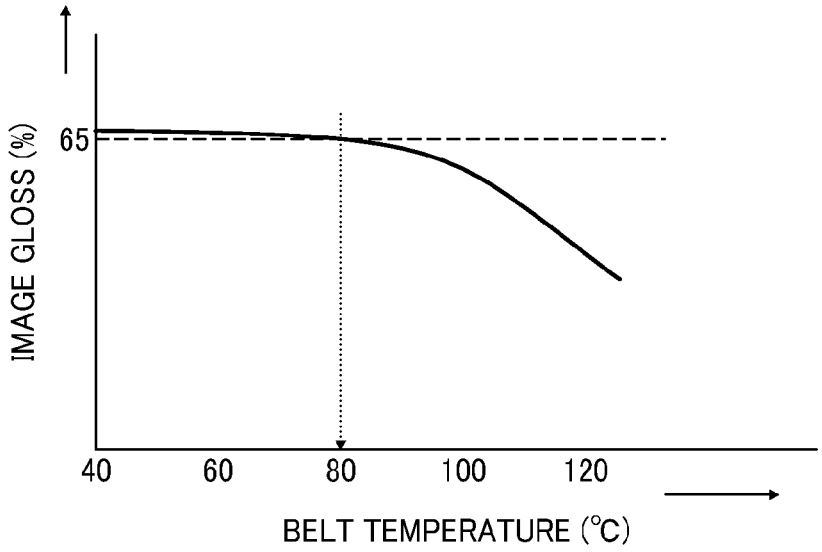
FIG. 5 is a graph showing a relation between temperature, in degrees Celsius, of a cooling belt and image gloss, in percent, on a first printed surface of a recording medium.

FIG. 5 is a graph showing a relation between temperature, in degrees Celsius, at the outer surface of the cooling belt 31 upon entry into the glossing nip Ng and image gloss, in percent, on the first printed surface of a recording medium S, as measured using a 20-degree glossmeter.

As shown in FIG. 5, the image gloss remains at a substantially constant level of approximately 65% as long as the belt temperature remains below a threshold temperature of 80° C., and starts to decline as the belt temperature exceeds the threshold temperature. Such relation between the image gloss and the belt temperature demonstrates efficacy of maintaining the belt temperature equal to or below the upper limit of 80° C. to obtain good duplex printing without detracting from uniform, high gloss on the first printed surface of a recording medium.

Figure 6:
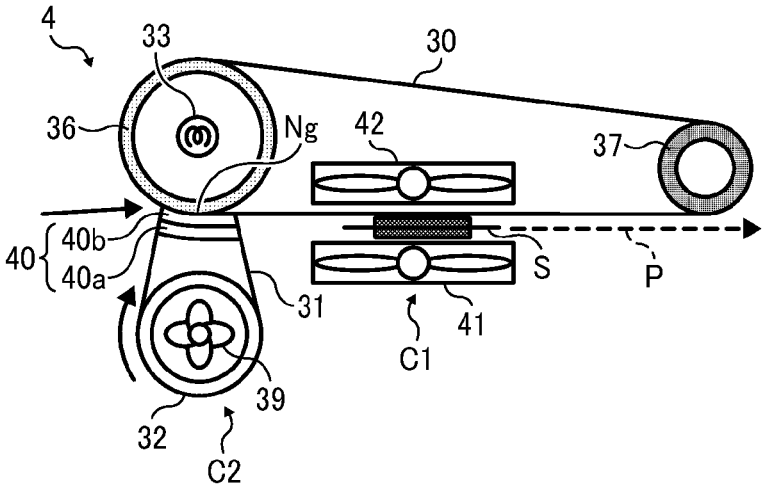
FIG. 6 is an end-on, axial view of the glossing device according to another embodiment of this patent specification.

Referring now to FIG. 6 and subsequent drawings, a description is given below of specific configurations of the second belt cooler C2 according to further embodiments of this patent specification.

FIG. 6 is an end-on, axial view of the glossing device 4 according to another embodiment of this patent specification, the overall configuration of which is similar to that depicted primarily with reference to FIG. 3, except for the configuration of the pressure member 40.

Specifically, as shown in FIG. 6, the pressure member 40 in the present embodiment comprises a stationary pad formed of an elongated base 40*a* of rigid material such as resin extending parallel to the heat roller 36, and a contact layer 40*b* of elastic material such as sponged silicone rubber, approximately 2 mm to approximately 10 mm thick, deposited on the elongated base 40*a* for contacting the cooling belt 31. Optionally, an anti-friction sheet impregnated with lubricant may be provided over the contact layer 40*b* where the pressure pad 40 slides against the cooling belt 31 for reducing friction between the pad and belt surfaces.

Compared to the foregoing embodiment, the glossing device 4 in the present embodiment can be operated with increased thermal efficiency in cooling the cooling belt 31, as the pressure pad 40 exhibits a relatively low heat capacity compared to that of a cylindrical roller, while allowing for proper width and strength across a glossing nip between the heat roller and the pressure member, leading to compact size and high operational speed of the glossing process.

Figure 7:
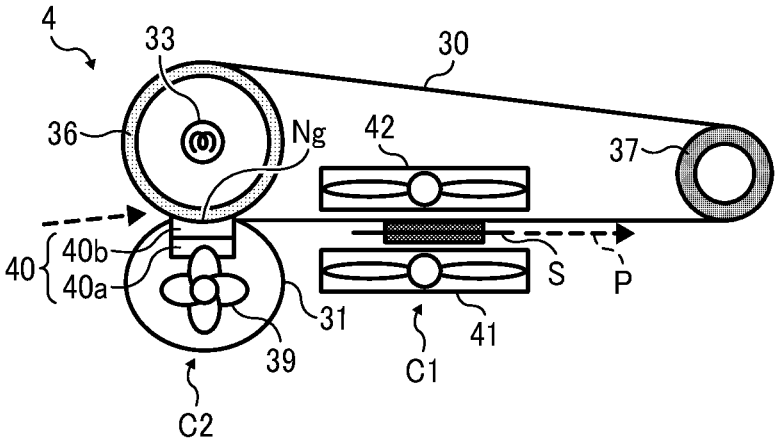
FIG. 7 is an end-on, axial view of the glossing device according to still another embodiment of this patent specification.

FIG. 7 is an end-on, axial view of the glossing device 4 according to still another embodiment of this patent specification, the overall configuration of which is similar to that depicted with reference to FIG. 6, except for the configuration of the second belt cooler C2.

Specifically, as shown in FIG. 7, the second belt cooler C2 in the present embodiment comprise a pair of cooling fans 39, one on each of two opposed, axial ends of the cooling belt 31 in its looped, cylindrical configuration, of which only one is visible in FIG. 3. Both cooling fans 39 serve to blow air in one axial direction of the cooling belt 31 to together generate an air flow from one end to the other of the cooling belt 31. Additionally, a belt support member, such as a roller, may be provided parallel to the pressure pad 40 for entraining the cooling belt 31 therearound.

In such a configuration, the second belt cooler C2 can effectively cool the cooling belt 31 with the cooling fans 39 directly facing the pressure pad 40 inside the loop of the cooling belt 31 to internally cool the cooling belt 31 together with the pressure pad 40. Such arrangement works equally well where the pressure member is configured as a cylindrical roller instead of a stationary pad.

As is the case with the foregoing embodiment, the glossing device 4 in the present embodiment can be operated with increased thermal efficiency in cooling the cooling belt 31, as the pressure member configured as a stationary pad exhibits a relatively low heat capacity compared to that of a cylindrical roller, while allowing for proper width and strength across a glossing nip between the heat roller and the pressure member, leading to compact size and high operational speed of the glossing process.

Figure 8:
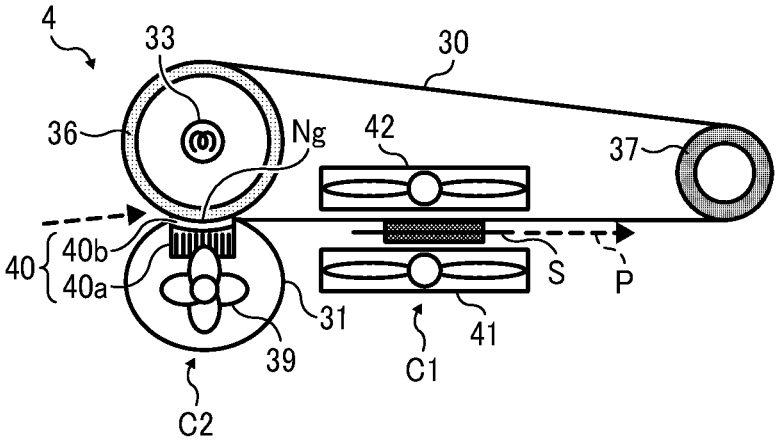
FIG. 8 is an end-on, axial view of the glossing device according to still another embodiment of this patent specification.

FIG. 8 is an end-on, axial view of the glossing device 4 according to still another embodiment of this patent specification, the overall configuration of which is similar to that depicted with reference to FIG. 7, except for the configuration of the pressure member 40.

Specifically, as shown in FIG. 8, the elongated base 40*a* of the pressure pad 40 in the present embodiment comprises a piece of thermally conductive metal, instead of resin, which may be formed in the shape of a fin or heat sink for obtaining increased surface area of the pressure pad 40 where it faces the cooling fan 39. Also, the elastic layer 40*b* of the pressure pad 40 comprises a layer of thermally conductive resin that exhibits a relatively high thermal conductivity.

In such a configuration, the second belt cooler C2 can effectively cool the cooling belt 31 with the thermally conductive material allowing substantial heat to conduct from the cooling belt 31 to the pressure pad 40 for eventual dissipation with the cooling fans 39.

Such arrangement works equally well where the pressure member is configured as a rotatably driven cylindrical roller instead of a stationary pad.

Although in the foregoing embodiments, the cooling roller and the fans are depicted as being disposed inside the loop of the cooling belt 31, the second belt cooler C2 may have its cooling elements disposed outside the loop of the cooling belt 31 for more effective cooling of the outer surface of the cooling belt 31 which directly faces the surface of a recording medium at the glossing nip Ng. In such cases, for preventing damage to the belt outer surface and concomitant adverse effects on the resulting print, the cooling elements are configured as those that can remove heat without contacting or otherwise sliding against the cooling belt, such as a cooling fan and a rotatable cooling roller. Several such examples are depicted below with reference to FIGS. 9, 10A and 10B.

Figure 9:
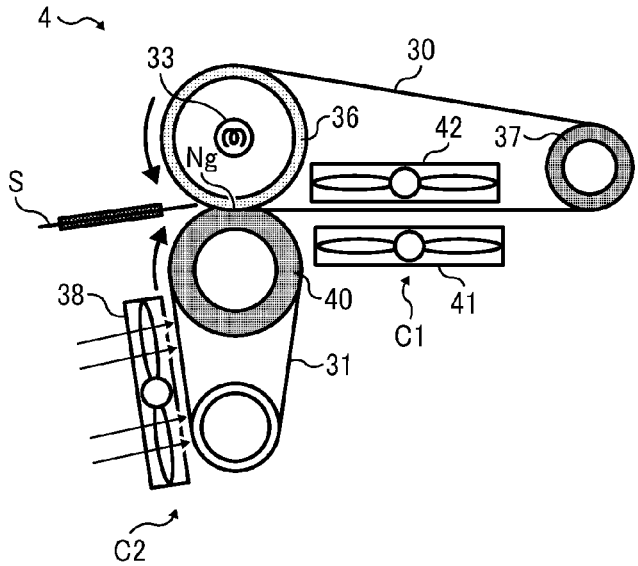
FIG. 9 is an end-on, axial view of the glossing device according to still another embodiment of this patent specification.

For example, as shown in FIG. 9, which is an end-on, axial view of the glossing device 4 according to still another embodiment of this patent specification, the second belt cooler C2 may be configured as a cooling fan 38 disposed outside the loop of the cooling belt 31 to blow air to the cooling belt 31.

Figure 10A:
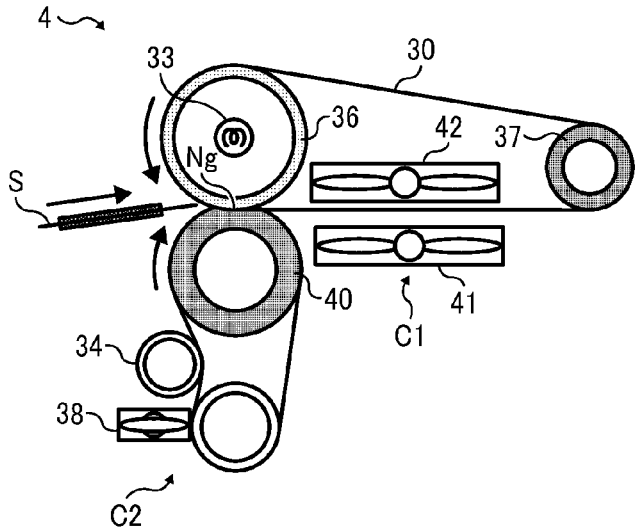
FIGS. 10A and 10B are an end-on, axial view of the glossing device and a side view of a second belt cooler, respectively, according to yet still another embodiment of this patent specification.
Figure 10B:
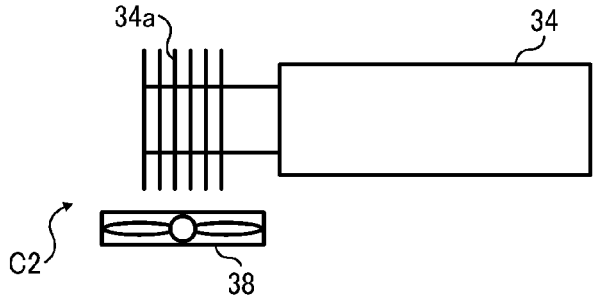

Also, as shown in FIGS. 10A and 10B, which are an end-on, axial view of the glossing device 4 and a side view of the second belt cooler C2, respectively, according to yet still another embodiment of this patent specification, the second belt cooler C2 may be configured as a cooling roller 34 having its one longitudinal end formed in the shape of a fin or heat sink 34*a*, and disposed outside the loop of the cooling belt 31 to rotate in contact with the cooling belt 31, and a cooling fan 38 disposed adjacent to the cooling roller 34 to blow air to the finned end 34*a* of the cooling roller 34.

Hence, the glossing device 4 according to this patent specification can process a toner image using an endless rotary belt with high-gloss, high-quality imaging performance, owing to the special configuration of the glossing belt 30 and the cooling belt 31 moving apart from each other downstream from the glossing nip Ng, which effectively prevents image defects resulting from a difference in circumferential speed between the opposed rotating belts, while allowing for proper dissipation of water content from the recording medium after passage through the glossing nip. Also, the glossing device 4 can process a duplex-printed recording medium S with high-gloss, defectless images on both sides of the resulting print, wherein provision of the cooling belt 31 with the second belt cooler C2 prevents undesired re-melting of the first toner image T1 during processing of the second toner image T2, which would otherwise lead to concomitant loss of gloss and unstable quality of the first printed surface of the resulting print. The image forming apparatus 100 incorporating the fixing device 4 according to one or more embodiments of this patent specification benefits from those and other effects of the fixing device 4.

As used herein, the term "glossing device" herein encompasses any device including a pair of opposed rotary members to process a toner image on a recording medium with heat and pressure, the scope of which is not limited to those designed to gloss an unfixed or pre-fixed toner image with heat and pressure, but also include those designed to simply fix a toner image.

Although in several embodiments described herein, the glossing device 4 is shown positioned immediately downstream from the fixing device 3 along the sheet conveyance path, the glossing device 4 according to this patent specification may be configured otherwise than as specifically disclosed herein. For example, the glossing device 4 may be provided at a separate position downstream from the fixing device 3, such as exterior to the image forming apparatus 100.

In such cases, the glossing device 4 may be configured as a self-contained, stand-alone machine in which the glossing and cooling belt assemblies as well as other pieces of equipment, such as the controller and the rotary driver, are integrated into a single integrated unit for mounting in a free-standing enclosure to which a user can supply a recording medium after processing through the image forming apparatus where desired.

Numerous additional modifications and variations are possible in light of the above teachings. It is therefore to be understood that, within the scope of the appended claims, the disclosure of this patent specification may be practiced otherwise than as specifically described herein.

What is claimed is:

1. A glossing device for processing a toner image formed on a recording medium, the device comprising:

a heat roller subjected to heating;

a stripper roller parallel to the heat roller;

an endless, rotary glossing belt looped for rotation around the heat roller and the stripper roller;

a first belt cooler adjacent to the glossing belt to cool the glossing belt;

a pressure member opposite the heat roller;

an endless, rotary cooling belt looped for rotation around the pressure member; and a second belt cooler adjacent to the cooling belt to cool the cooling belt, the heat roller and the pressure member pressing against each other via the glossing belt and the cooling belt to form a glossing nip therebetween through which the recording medium is conveyed with a first surface thereof facing the cooling belt and a second surface opposite the first surface thereof facing the glossing belt, the glossing belt and the cooling belt moving apart from each other downstream from the glossing nip, so that the recording medium after passage through the glossing nip remains in contact with the glossing belt and separates from the cooling belt as the glossing belt moves from the heat roller toward the stripper roller.

2. The glossing device according to claim 1, further comprising:

a thermometer adjacent to the cooling belt for detecting an operational temperature of the cooling belt; and a controller operatively connected with the second belt cooler and the thermometer for controlling operation of the second belt cooler to adjust the operational temperature of the cooling belt according to readings of the thermometer.

3. The glossing device according to claim 2, wherein during processing of a recording medium that has a first toner image already fixed and glossed on the first surface thereof, and a second toner image fixed and yet to be glossed on the second surface thereof, the operational temperature of the cooling belt is adjusted so as to keep the first toner image in a solid, fixed state where the first surface of the recording medium contacts the cooling belt.

4. The glossing device according to claim 1, wherein the second belt cooler is disposed inside the loop of the cooling belt to internally cool the cooling belt together with the pressure member.

5. The glossing device according to claim 1, wherein the second belt cooler is disposed outside the loop of the cooling belt to externally cool the cooling belt.

6. The glossing device according to claim 1, wherein the second belt cooler includes a cooling device selected from the group consisting of a cooling fan, a heat sink, a heat pipe, a Peltier cooler, and combinations thereof.

7. The glossing device according to claim 1, wherein the second belt cooler includes a hollow, thermally conductive cooling roller around which the cooling belt is entrained to dissipate heat from the cooling belt to the cooling roller.

8. The glossing device according to claim 7, wherein the second belt cooler further includes a pair of cooling fans, one on each of two opposed, axial ends of the cooling roller, both cooling fans blowing air in one axial direction of the cooling roller to together generate an air flow from one end to the other of the cooling roller.

9. The glossing device according to claim 8, wherein the second belt cooler further includes a pair of air ducts, one coupled to each cooling fan, both air ducts leading to the exterior of an enclosure in which the glossing device is installed to ventilate the cooling roller.

10. The glossing device according to claim 1, wherein the second belt cooler includes a pair of cooling fans, one on each of two opposed, axial ends of the cooling belt in its looped, cylindrical configuration, both cooling fans blowing air in one axial direction of the cooling belt to together generate an air flow from one end to the other of the cooling belt.

11. The glossing device according to claim 1, wherein the second belt cooler includes a cooling fan disposed outside the loop of the cooling belt to blow air to the cooling belt.

12. The glossing device according to claim 1, wherein the second belt cooler includes:

a cooling roller having its one longitudinal end formed in the shape of a fin, and disposed outside the loop of the cooling belt to rotate in contact with the cooling belt; and a cooling fan disposed adjacent to the cooling roller to blow air to the finned end of the cooling roller.

13. The glossing device according to claim 1, wherein the pressure member comprises a rotatably driven cylindrical roller.

14. The glossing device according to claim 1, wherein the pressure member comprises a stationary pad formed of an elongated base and an elastic layer disposed on the base to contact the cooling belt.

15. The glossing device according to claim 14, wherein the base of the pressure pad comprises a finned piece of thermally conductive metal.

16. The glossing device according to claim 14, wherein the elastic layer of the pressure pad comprises a layer of thermally conductive resin.

17. The glossing device according to claim 14, wherein the pressure member further includes an anti-friction sheet impregnated with lubricant and disposed over the elastic layer.

18. The glossing device according to claim 1, wherein the cooling belt comprises a looped, endless flexible belt formed of a substrate of heat-resistant material, and an outer layer of release agent overlying the substrate.

19. An image forming apparatus comprising:

an imaging unit to form a toner image on a recording medium; and a glossing device to process the toner image with heat and pressure on the recording medium, the device comprising:

a heat roller subjected to heating;

a stripper roller parallel to the heat roller;

an endless, rotary glossing belt looped for rotation around the heat roller and the stripper roller;

a first belt cooler adjacent to the glossing belt to cool the glossing belt;

a pressure member opposite the heat roller;

an endless, rotary cooling belt looped for rotation around the pressure member; and a second belt cooler adjacent to the cooling belt to cool the cooling belt, the heat roller and the pressure member pressing against each other via the glossing belt and the cooling belt to form a glossing nip therebetween through which the recording medium is conveyed, the glossing belt and the cooling belt moving apart from each other downstream from the glossing nip, so that the recording medium after passage through the glossing nip remains in contact with the glossing belt and separates from the cooling belt as the glossing belt moves from the heat roller toward the stripper roller.

20. The image forming apparatus according to claim 19, further comprising a duplex unit connected to the imaging unit to allow image formation on a pair of opposed, first and second surfaces of a recording medium, wherein the imaging unit initially forms a first toner image on the first surface, and a second toner image on the second surface subsequent to processing of the first toner image through the glossing device, the recording medium being conveyed through the glossing nip with the first surface facing the glossing belt and the second surface facing the cooling belt during processing of the first toner image, and with the second surface facing the glossing belt and the first surface facing the cooling belt during processing of the second toner image.

* * * * *